US010845082B2

(12) United States Patent
Endel et al.

(10) Patent No.: US 10,845,082 B2
(45) Date of Patent: Nov. 24, 2020

(54) OPERATING HEATING, VENTILATION, AND AIR CONDITIONING SYSTEMS USING OCCUPANCY SENSING SYSTEMS

(71) Applicant: Honeywell International Inc., Morris Plains, NJ (US)

(72) Inventors: Petr Endel, Prague (CZ); Ondrej Holub, Prague (CZ); Karel Marik, Revnice (CZ)

(73) Assignee: Honeywell International Inc., Charlotte, NC (US)

( * ) Notice: Subject to any disclaimer, the term of this patent is extended or adjusted under 35 U.S.C. 154(b) by 6 days.

(21) Appl. No.: 16/224,675

(22) Filed: Dec. 18, 2018

(65) Prior Publication Data

US 2020/0191428 A1 Jun. 18, 2020

(51) Int. Cl.

| | |
|---|---|
| ***G05B 21/00*** | (2006.01) |
| ***G01M 1/38*** | (2006.01) |
| ***G05B 13/00*** | (2006.01) |
| ***G05B 15/00*** | (2006.01) |
| ***F24F 11/62*** | (2018.01) |
| ***F24F 11/88*** | (2018.01) |
| ***F24F 11/46*** | (2018.01) |
| *F24F 120/12* | (2018.01) |

(52) U.S. Cl.

CPC ..... *F24F 11/62* (2018.01); *F24F 11/46* (2018.01); *F24F 11/88* (2018.01); *F24F 2120/12* (2018.01)

(58) Field of Classification Search

CPC .. F24F 11/46; F24F 11/62; F24F 11/49; F24F 11/88; F24F 2120/12

USPC ..... 700/276

See application file for complete search history.

(56) References Cited

U.S. PATENT DOCUMENTS

| | | | | |
|---|---|---|---|---|
| 2010/0235004 | A1* | 9/2010 | Thind | G05B 15/02 700/277 |
| 2012/0323376 | A1* | 12/2012 | Honda | G05D 23/1932 700/276 |
| 2016/0012340 | A1* | 1/2016 | Georgescu | G05B 15/02 700/276 |
| 2017/0105129 | A1* | 4/2017 | Teplin | H04W 24/02 |
| 2018/0299845 | A1* | 10/2018 | Ray | G06Q 10/063 |
| 2019/0171171 | A1* | 6/2019 | Verteletskyi | G05B 19/042 |

* cited by examiner

*Primary Examiner* — Md Azad

(74) *Attorney, Agent, or Firm* — Seager Tufte & Wickhem LLP

(57) ABSTRACT

Operating HVAC systems using occupancy sensing systems is described herein. One device includes instructions to receive a mapping describing relationships between a space of a plurality of spaces of a building, a plurality of fixtures of an occupancy sensing system installed in the space, and an upstream HVAC device associated with the building, wherein the upstream HVAC device serves a zone including the space, receive occupancy data determined by the fixture over a time period, filter the occupancy data to determine occupancy information associated with the fixture over the time period, determine an occupancy model associated with the space based on the occupancy information associated with the fixtures, and modify an operation of the upstream HVAC device based on the mapping and the occupancy model.

20 Claims, 15 Drawing Sheets

BUILDING SEGMENTS

732

| building_segment_ID | building_segment_name | building_segment_ID_orig |
|---|---|---|
| '1' | 'Bldg1,floor1' | '1' |
| '2' | 'Bldg1,floor2' | '34' |
| '3' | 'Bldg2' | '35' |

Fig. 7

FLOORS

834

| floor_ID | floor_name |
|---|---|
| '1' | 'First floor' |
| '2' | 'Second floor' |

Fig. 8

SPACES

936

| space_ID | space_name | space_ID_orig |
|---|---|---|
| 1 | 'HBS TRAINING LAB B 2-1414' | 532 |
| 2 | 'TRAINING 2-1412' | 533 |
| 3 | 'HBS TRAINING LAB A 2-1416' | 534 |
| 4 | 'TRAINING 2-1424' | 546 |
| 5 | 'AUDITORIUM 2-1450' | 547 |

Fig. 9

HVAC EQUIPMENT

1038

| hvac_ID | hvac_name | hvac_ID_orig |
|---|---|---|
| 1 | 'VAV_1_11_01' | 4463 |
| 2 | 'VAV_1_11_02' | 4464 |
| 3 | 'VAV_1_11_03' | 4465 |

Fig. 10

FIXTURES

| fixture_ID | fixture_name | x_coordinate | y_coordinate | MAC_address | fixture_ID_orig |
|---|---|---|---|---|---|
| 1 | 'Sensor12f255' | '3721' | '1833' | '12:f2:55' | '1732' |
| 2 | 'Sensor13123e' | '3723' | '1786' | '13:12:3e' | '1733' |
| 3 | 'Sensor131350' | '3723' | '1880' | '13:13:50' | '1734' |

1140

Fig. 11

FLOORS TO BUILDING SEGMENTS

1242

| floor_ID | building_segment_ID | *From Definitory tables* | |
|---|---|---|---|
| '1' | '1' | First floor | Bldg 1, floor 1 |
| '1' | '3' | First floor | Bldg 2 |
| '1' | '4' | First floor | Bldg 3 |
| '1' | '5' | First floor | Silent Knight |
| '2' | '2' | Second floor | Bldg 1, floor 2 |

Fig. 12

SPACES TO FLOORS

1344

| space_ID | floor_ID | *From Definitory tables* | |
|---|---|---|---|
| 8 | 1 | TRAINING 2-1410 | First floor |
| 9 | 1 | TRAINING 2-1408 | First floor |

Fig. 13

HVAC TO SPACES

1446

| hvac_ID | space_ID | *From Definitory tables* | |
|---|---|---|---|
| 179 | 9 | VAV_2_04_01 | TRAINING 2-1408 |
| 179 | 361 | VAV_2_04_01 | CORRIDOR 2-1264 |
| 180 | 8 | VAV_2_04_02 | TRAINING 2-1410 |

Fig. 14

FIXTURES TO SPACES

1548

| fixture_ID | space_ID | *From Definitory tables* | |
|---|---|---|---|
| 1864 | 9 | Sensor12f963 | TRAINING 2-1408 |
| 1865 | 9 | Sensor131291 | TRAINING 2-1408 |
| 1866 | 9 | Sensor12f951 | TRAINING 2-1408 |
| 1867 | 9 | Sensor130433 | TRAINING 2-1408 |
| 1868 | 9 | Sensor12f949 | TRAINING 2-1408 |

Fig. 15

OPERATING HEATING, VENTILATION, AND AIR CONDITIONING SYSTEMS USING OCCUPANCY SENSING SYSTEMS

TECHNICAL FIELD

The present disclosure relates to devices, systems, and methods for operating heating, ventilation, and air conditioning systems using occupancy sensing systems.

BACKGROUND

A heating, ventilation, and air conditioning (HVAC) system can be used to control the environment of a building. For example, an HVAC system can be used to control the air temperature, humidity, and/or air quality of a building. An HVAC system can be operated based on occupancy information. A determination of whether a space of a building is occupied, for example, may govern the operation of one or more HVAC devices dedicated to that space.

Previous approaches to operating HVAC systems based on occupancy may face issues associated with the separate nature of occupancy sensing systems and HVAC systems. For instance, occupancy sensing systems and HVAC systems may be installed and/or managed by different entities and thus may utilize different proprietary concepts, such as naming conventions and/or labels for spaces in the building. Additionally, some information associated with either occupancy sensing systems or HVAC systems may be difficult to obtain in a readily useful (e.g., machine-readable) format, as such information may be included in floor plans and/or schemas.

Because previous approaches may fail to fully describe relationships between occupancy sensing systems and HVAC systems, portions of a building may be scheduled for conditioning (e.g., heating or cooling) irrespective of actual occupancy patterns in a space. Misapplication of heating or cooling may result in increased energy costs and/or reduced human comfort.

BRIEF DESCRIPTION OF THE DRAWINGS

FIG. 7 illustrates a building segments definitory table in accordance with one or more embodiments of the present disclosure.

FIG. 8 illustrates a floors definitory table in accordance with one or more embodiments of the present disclosure.

FIG. 9 illustrates a spaces definitory table in accordance with one or more embodiments of the present disclosure.

FIG. 10 illustrates an HVAC equipment definitory table in accordance with one or more embodiments of the present disclosure.

FIG. 11 illustrates a fixtures definitory table in accordance with one or more embodiments of the present disclosure.

FIG. 12 illustrates a floor-to-building-segment mapping table in accordance with one or more embodiments of the present disclosure.

FIG. 13 illustrates a space-to-floor mapping table in accordance with one or more embodiments of the present disclosure.

FIG. 14 illustrates an HVAC-to-space mapping table in accordance with one or more embodiments of the present disclosure.

FIG. 15 illustrates a fixture-to-space mapping table in accordance with one or more embodiments of the present disclosure.

DETAILED DESCRIPTION

Figure 1:
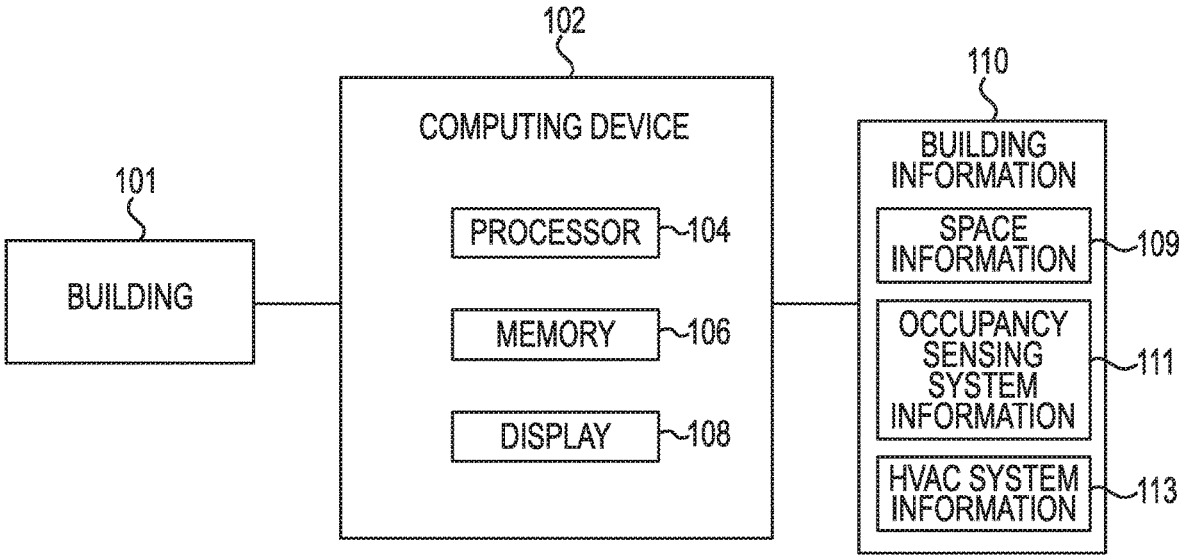
FIG. 1 illustrates a computing device for operating HVAC systems using occupancy sensing systems in accordance with one or more embodiments of the present disclosure.

Operating heating, ventilation, and air conditioning (HVAC) systems using occupancy sensing systems is described herein. For example, one or more embodiments include a non-transitory machine-readable medium having instructions stored thereon which, when executed by a processor, cause the processor to receive a mapping describing relationships between a space of a plurality of spaces of a building, a plurality of fixtures of an occupancy sensing system installed in the space, and an upstream HVAC device of a plurality of upstream HVAC devices associated with the building, wherein the upstream HVAC device is configured to serve a zone including the space, receive occupancy data determined by the fixture over a period of time, filter the occupancy data to determine occupancy information associated with the fixture over the period of time, determine an occupancy model associated with the space based on the occupancy information associated with the fixtures, and modify an operation of the upstream HVAC device based on the mapping and the occupancy model.

Embodiments of the present disclosure can unite the often separate digital-ceiling-based occupancy sensing systems and HVAC systems in order to provide more informed HVAC operation. Increased human comfort and cost savings can be realized when an HVAC system is informed by occupancy information.

An HVAC system, as referred to herein, is a system used to control the environment of a building. For example, an HVAC system can be used to control the air temperature, humidity, and/or air quality of a building. An HVAC system can include a plurality of different devices and/or equipment, an example list including thermostats, fans, ducts, air conditioners, furnaces, humidifiers, variable air volume (VAV) devices (referred to herein as "VAVs"), air handling units (AHUs), rooftop units (RTUs), chillers, boilers, etc.

An occupancy sensing system (e.g., a digital ceiling), as referred to herein, is a system used to detect the presence of a person in a given portion (e.g., space) of a building. Occupancy sensing systems can include motion detecting sensing devices (sometimes referred to herein as "occupancy sensors" or "sensors") employing infrared, ultrasonic, microwave, and/or other technologies, for instance. It is noted, however, that occupancy sensing systems are not limited herein to a particular type of sensor and/or sensing system.

A "space," as referred to herein, is a particular portion of a building. In some embodiments, a space can be defined by one or more structural elements (e.g., walls, doors, stairs, etc.). In some embodiments, a space may not be defined by one or more structural elements. In some embodiments, a space may refer to a single room. In some embodiments, a space may refer to more than one room. In some embodiments, a space may refer to a portion of a building (e.g., a polygon on a floorplan of a building) that is a subset of a larger room.

The term "digital ceiling," as used herein, refers generally to the usage of a building's plenum (e.g., space in the ceiling where wiring, cabling, and/or ductwork run) for placement of sensors and/or other network devices. In many instances, a digital ceiling may be installed in an existing building (e.g., the building may be retrofitted with a digital ceiling). In some embodiments, a digital ceiling may be partially embodied by occupancy sensors installed in, and/or associated with, existing fixtures of a building. Accordingly, where used herein, the term "digital ceiling" is an occupancy sensing system comprising a plurality of occupancy sensors installed near, in, or partially in, a ceiling of a building. A digital ceiling may refer to such sensors installed in ceiling-mounted light fixtures, for instance, though embodiments of the present disclosure are not so limited. In some embodiments, such occupancy sensing system sensors may be installed into light fixtures during refurbishment of the fixtures. The term "occupancy sensing system," where used herein, may refer to a digital ceiling.

An occupancy sensing system may be useful in operating an HVAC system in order to provide increased human comfort and/or save resources (e.g., cost, energy, etc.). As previously discussed, however, occupancy sensing systems and HVAC systems may be installed and/or managed by different entities. For example, an HVAC contractor may install the building's HVAC system, and a lighting contractor may install the building's occupancy sensing system. These entities may utilize different proprietary concepts, such as naming conventions and/or labels for spaces in the building. What is more, in cases where a building is retrofitted with an occupancy sensing system, the HVAC installation and occupancy sensing system installation may be separated by a number of years. Additionally, information associated with either occupancy sensing systems or HVAC systems may be difficult to obtain in a readily useful (e.g., machine-readable) format, as such information may be included merely in floor plans and/or schemas. These issues have frustrated previous approaches to the operation of an HVAC system using an occupancy sensing system.

Embodiments of the present disclosure can merge and/or unite occupancy sensing systems and HVAC systems. As discussed further below, embodiments herein can merge the disparate systems to create semantic mappings. Among other things, mappings can describe the relationships between fixtures (e.g., sensors) and spaces of a building. Mappings can describe the relationships between HVAC devices (e.g., VAVs) and spaces of a building. The mappings can be used by a computing device (e.g., computing device and/or controller) to link an HVAC device associated with a particular space to the fixture(s) installed in that space. Accordingly, the occupancy determinations made by the fixture(s) in the space can be used to operate the HVAC device. As a result, the computing device managing the building can operate more effectively to provide human comfort and can operate more efficiently to save resources in unoccupied spaces, for instance.

Embodiments of the present disclosure can utilize occupancy information in controlling space or zone air properties. Historical occupancy information can be leveraged for whole hierarchical HVAC system control, yielding significant energy savings and improved human comfort. In previous approaches, conditioning (e.g., heating and/or cooling) schedules for spaces of a building may be followed regardless of the actual occupancy patterns of those spaces. According to the present disclosure, incorporating actual occupancy patterns into a determination of scheduling HVAC operations can more precisely align the runtime of HVAC devices with human occupancy. Thus, embodiments herein can bring desired heating and/or cooling while yielding electricity and/or gas savings.

Embodiments herein can form a mapping between spaces of a building, occupancy sensing fixtures installed in the building, and HVAC devices of the building that provides contextual information regarding which devices govern comfort in which spaces. Embodiments herein can use that contextual information in conjunction with occupancy information to modify the operation(s) of HVAC devices.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized, and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of manipulated variables" can refer to one or more manipulated variables.

FIG. 1 illustrates a computing device 102 for operating HVAC systems using occupancy sensing systems in accordance with one or more embodiments of the present disclosure. The computing device 102 can control the operation of the devices of an occupancy sensing system and/or an HVAC system installed in a building 101. Where the term "building" is used herein, is to be understood that such usage can refer to a single building and/or multiple buildings (e.g., a campus, compound, etc.).

As shown in FIG. 1, the computing device 102 can include a memory 106 and a processor 104. Memory 106 can be any type of storage medium that can be accessed by processor 104 to perform various examples of the present disclosure. For example, memory 106 can be a non-transitory computer readable medium having computer readable instructions (e.g., computer program instructions) stored thereon that are executable by processor 104 to receive building information 110, create mappings, and modify operations of HVAC devices in accordance with the present disclosure and as discussed further below. Stated differently, processor 104 can execute the executable instructions stored in memory 106 to perform these steps, and others, in accordance with the present disclosure.

Memory 106 can be volatile or nonvolatile memory. Memory 106 can also be removable (e.g., portable) memory, or non-removable (e.g., internal) memory. For example, memory 106 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 106 is illustrated as being located in the computing device 102, embodiments of the present disclosure are not so limited. For example, memory 106 can also be located internal to another computing resource (e.g., enabling computer readable instructions to be downloaded over the Internet or another wired or wireless connection).

As shown in FIG. 1, the computing device 102 includes a display (e.g., user interface) 108. A user (e.g., operator) of the computing device 102 can interact with the computing device 102 via the display 108. For example, display 108 can provide (e.g., display and/or present) information to the user of computing device 102, and/or receive information from (e.g., input by) the user of computing device 102. For instance, in some embodiments, display 108 can be a graphical user interface (GUI) that can include a screen that can provide and/or receive information to and/or from the user of the computing device 102. The display 108 can be, for instance, a touch-screen display. Additionally or alternatively, the computing device 102 can include a keyboard and/or mouse the user can use to input information into the computing device 102. Embodiments of the present disclosure, however, are not limited to a particular type(s) of display or interface.

Embodiments herein can include hardware, firmware, and/or logic that can perform a particular function. As used herein, "logic" is an alternative or additional processing resource to execute the actions and/or functions, described herein, which includes hardware (e.g., various forms of transistor logic, application specific integrated circuits (ASICs)), as opposed to computer executable instructions (e.g., software, firmware) stored in memory and executable by a processing resource.

The computing device 102 can receive building information 110. In some embodiments, building information 110 includes space information 109 that defines a plurality of spaces of the building 101. In some embodiments, building information 110 includes occupancy sensing system information 111 that describes a location of each of a plurality of fixtures of an occupancy sensing system installed in the building 101 with respect to a representation (e.g., graphical depiction) of the building 101. In some embodiments, building information 110 includes HVAC system information 113 that describes a relationship between the plurality of spaces and a plurality of HVAC devices installed in the building 101. It is noted that while the example of VAV devices is discussed herein for purposes of example, embodiments of the present disclosure do not limit HVAC devices to a particular number of devices or to a particular device type. For example, the HVAC system information 113 can describe a diffuser relationship between the VAV device of the plurality of VAV devices and a diffuser of a plurality of diffusers of the HVAC system, a boiler relationship between the VAV device of the plurality of VAV devices and a boiler of a plurality of boilers of the HVAC system, and/or a rooftop unit (RTU) relationship between the VAV device of the plurality of VAV devices and an RTU of a plurality of RTUs of the HVAC system.

In some embodiments, occupancy sensing system information 111 can be received from an occupancy sensing system associated with the building 101. For example, the computing device 102 can query an application programming interface (API) associated with the occupancy sensing system for the occupancy sensing system information 111. In some embodiments, the occupancy sensing system information 111 can be in a text format that describes each of a plurality of fixtures using a unique identifier and a unique set of coordinates. In some embodiments, building information 110 can be received from a building information model (BIM) associated with the building 101 (e.g., a file including a BIM associated with the building 101). For example, HVAC system information 113 and/or space information 109 can be determined from BIM files associated with the building 101. In some embodiments, an interface (e.g., the display 108) can be used to receive user inputs to define the building information 110. For instance, user inputs can define each of the plurality of spaces of the building 101 as a respective polygon in a building floorplan.

In some embodiments, the formats of the received building information 110 may be the same. In some embodiments, the formats of the building information may be different. For example, the occupancy sensing system information 111 may be received as a bitmap file and the HVAC system information 113 may be received as a BIM file. In some embodiments, the space information 109 can be received in a first format, the occupancy sensing system information 111 can be received in a second format, and the HVAC system information 113 can be received in a third format.

The building information 110 can describe the spaces of the building 101, the fixtures, and/or the HVAC information using a coordinate system. In some embodiments, different coordinate systems may be used. For example, the occupancy sensing system information 111 can describe a coordinate location of each of the plurality of fixtures with respect to a first coordinate system associated with the building 101, and the HVAC system information 113 can describe a coordinate location of each of the plurality of HVAC devices with respect to a second coordinate system associated with the building. The different coordinate systems may, for instance, result from the different entities that install and/or maintain the systems.

Figure 2:
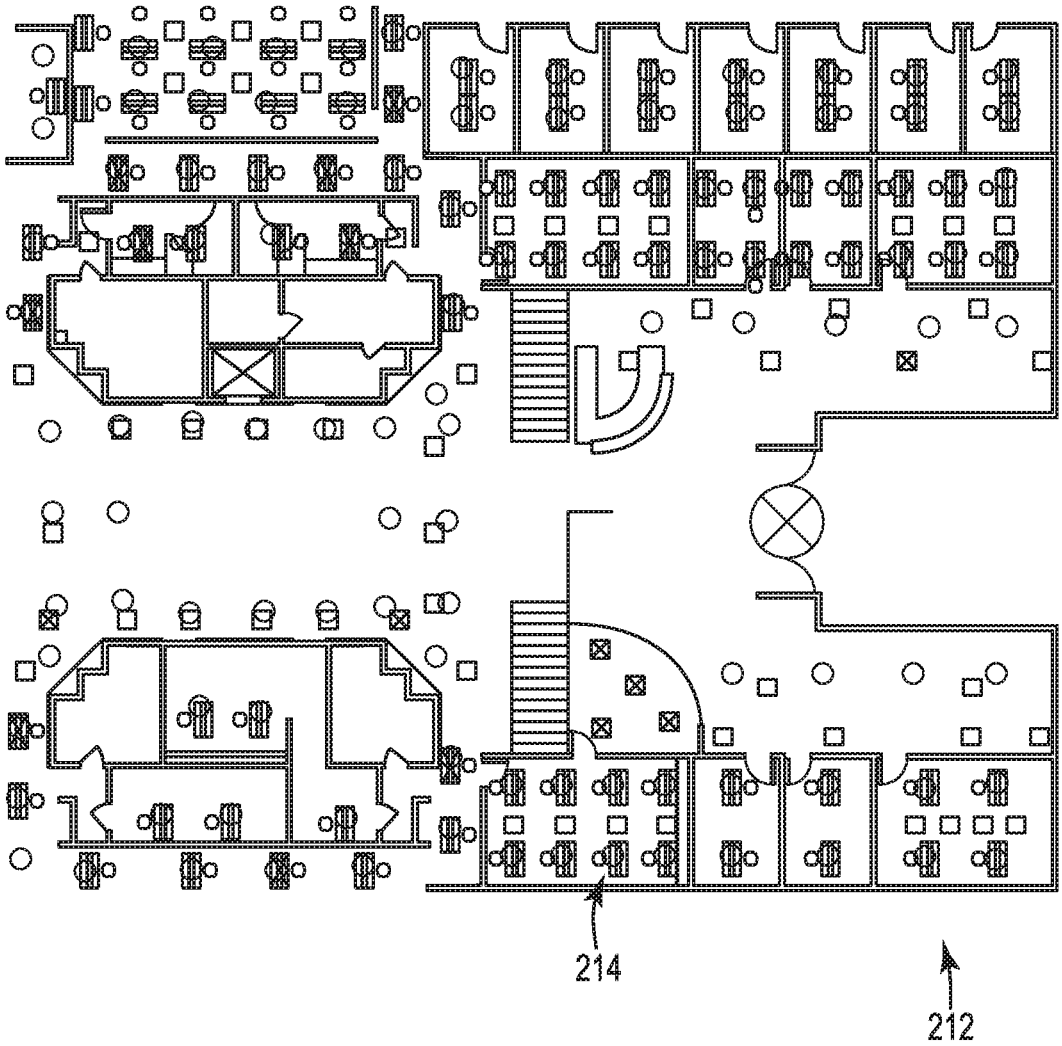
FIG. 2 illustrates a representation of a portion of a building that includes occupancy sensing system information associated with the building in accordance with one or more embodiments of the present disclosure.

FIG. 2 illustrates a representation 212 of a portion of a building that includes occupancy sensing system information associated with the building in accordance with one or more embodiments of the present disclosure. For instance, the representation 212 can be included in a bitmap file describing the occupancy sensing system of the building. Fixtures of the occupancy sensing system (e.g., motion sensors installed in lighting fixtures) are indicated in the representation 212 by circular display elements. For example, fixture 214 is indicated by a circular display element. The representation 212 (e.g., metadata associated with the representation 212) can include, for each fixture, a unique identifier and the coordinates (e.g., x, y coordinates) of the representation 212 where that fixture is found.

Figure 3:
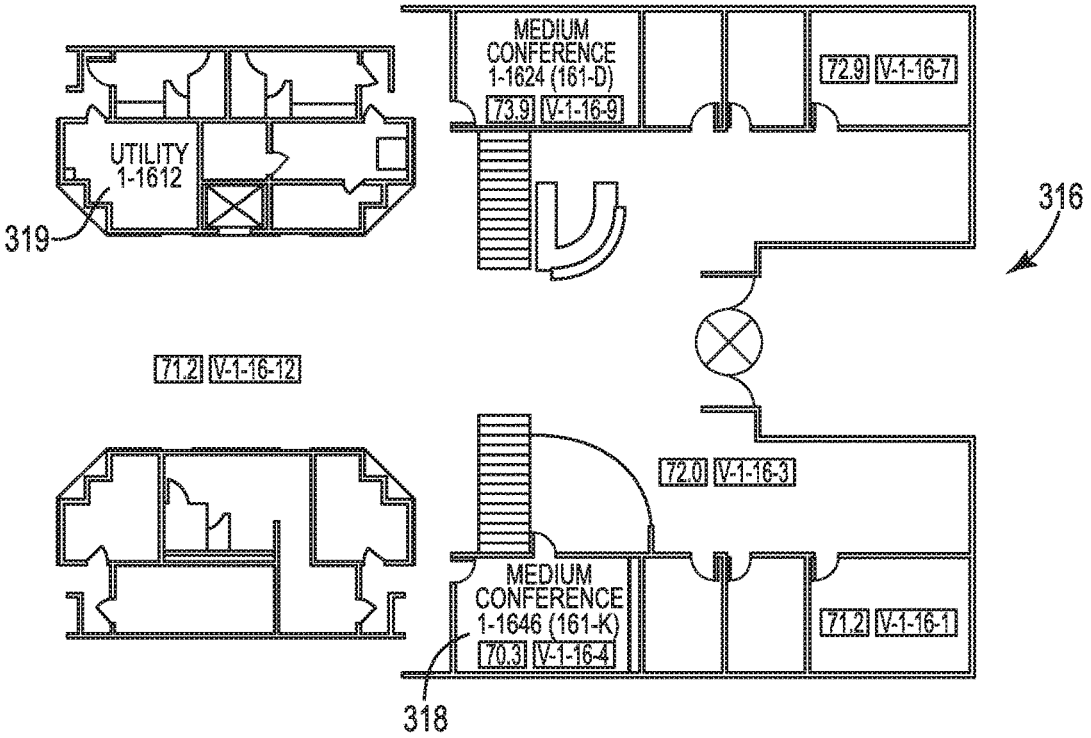
FIG. 3 illustrates another representation of the portion of the building that includes HVAC information and/or space information associated with the building in accordance with one or more embodiments of the present disclosure.

FIG. 3 illustrates another representation 316 of the portion of the building that includes HVAC information and/or space information associated with the building. For instance, the representation 316 can be included in a BIM file describing the building (e.g., spaces of the building and/or HVAC system devices of the building). Devices (e.g., VAVs) of the building are indicated in the representation 316 by a pair of display elements. For example, VAV 318 is indicated by a pair of display elements, one indicating a device identifier associated with the VAV 318 (e.g., V-1-16-4) and another indicating a current temperature supplied by the VAV 318 (e.g., 70.3 degrees Fahrenheit). The representation 316 (e.g., metadata associated with the representation 316) can include, for each device, the device identifier and the location where that device is found. The location of the device 318 in the BIM may be described using geographical coordinates (e.g., latitude and longitude), for instance, though embodiments herein are not so limited.

Spaces of the building are indicated in the representation 316 by a type and a space identifier. For example, space 319 is indicated by the type "Utility" and the space identifier "1-1612". The representation 316 (e.g., metadata associated with the representation 316) can include, for each space, the space identifier and the location where that space is found. The location of the space 319 in the BIM may be described using geographical coordinates (e.g., latitude and longitude), for instance, though embodiments herein are not so limited.

Figure 4:
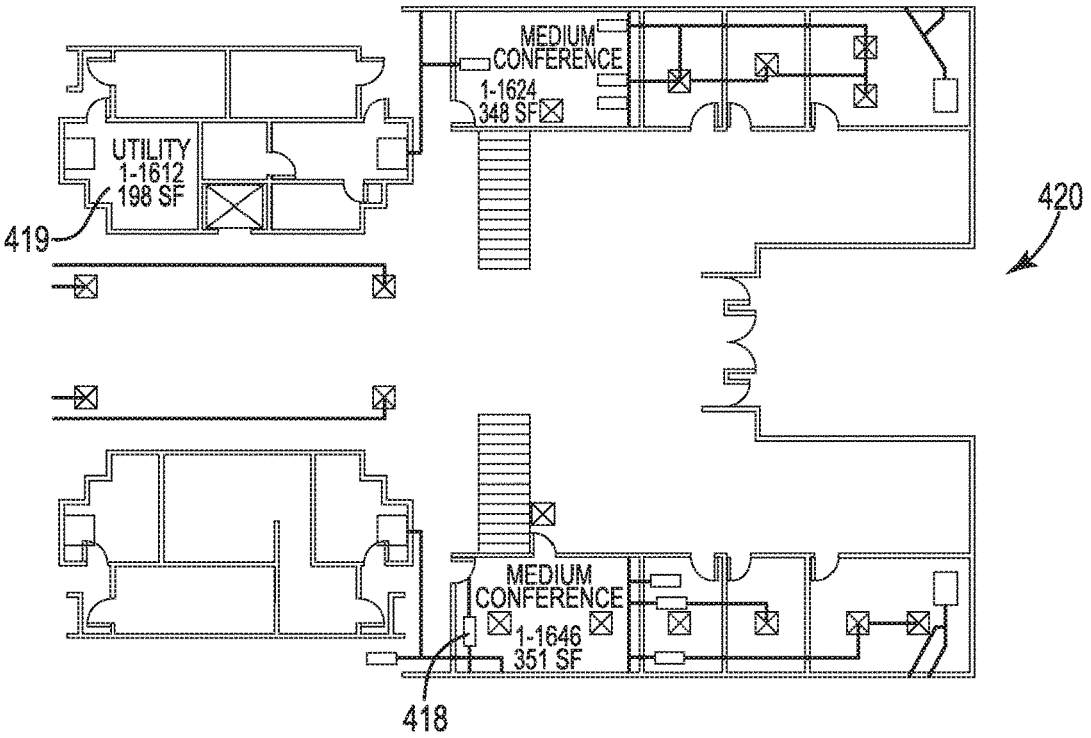
FIG. 4 illustrates another representation of the portion of the building that includes HVAC information and/or space information associated with the building in accordance with one or more embodiments of the present disclosure.

FIG. 4 illustrates another representation 420 of the portion of the building that includes HVAC information and/or space information associated with the building. For instance, the representation 420 can be included in a scalable vector graphics (SVG) and/or computer-aided design (CAD) file describing the building (e.g., spaces of the building and/or HVAC system devices of the building). In some embodiments, the representation 420 can be received from an architect and/or builder responsible for the construction of the building.

HVAC devices (e.g., VAVs) of the building are indicated in the representation 420 by rectangular display elements. For example, VAV 418 is indicated by a rectangular display element. The representation 420 (e.g., metadata associated with the representation 420) can include, for each device, a device identifier and the coordinates (e.g., x, y coordinates) of the representation 420 where that device is found (e.g., in a third coordinate system). It is noted that the coordinate system, and thus the coordinates for a particular HVAC device, fixture and/or space, used in the representation 420, the representation 212, and the representation 316 may differ.

Spaces of the building are indicated in the representation 420 by a type, a space identifier, and a size. For example, space 419 is indicated by the type "Utility," the space identifier "1-1612," and an indication that it is 198 square feet in size. The representation 420 (e.g., metadata associated with the representation 420) can include, for each space, a unique identifier and the coordinates (e.g., x, y coordinates) of the representation 420 where that space is found. In some embodiments, the representation 420 can include coordinates associated with indicators and/or structures defining the space, such as walls, doors, stairs, etc.

The computing device 102, previously described in connection with FIG. 1, can receive the representations 212, 316, and 420 and/or files along with the building information contained therein. In some embodiments, the representations can be operated upon in order to extract the building information therefrom. For instance, the computing device 102 can query an occupancy sensing system API and receive files (e.g., JavaScript Object Notation (JSON)) files that include fixture identifiers and coordinates. From this information, the computing device 102 can create a fixture file (e.g., a comma-separated values (CSV) file). The computing device 102 can load the fixture file and the SVG file describing the building, map the coordinate system used by the fixture file to the coordinate system used by the SVG file, and extract information describing the spaces served by the HVAC devices.

Figure 5:
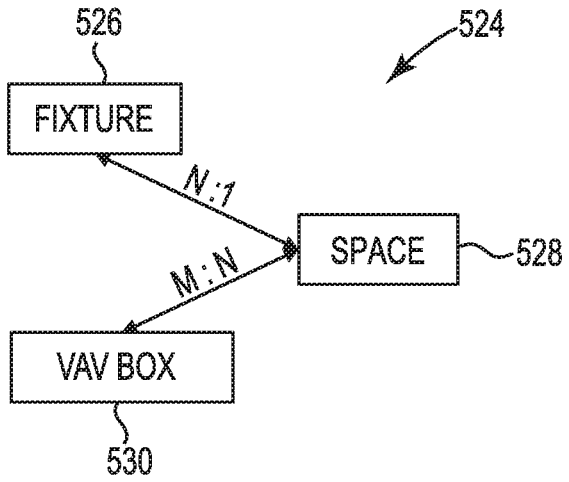
FIG. 5 illustrates a logical mapping associated with operating HVAC systems using occupancy sensing systems in accordance with one or more embodiments of the present disclosure.

Accordingly, the computing device 102 can create a mapping between a space of the plurality of spaces, a fixture of the plurality of fixtures, and an HVAC device of the plurality of HVAC devices based on the building information. FIG. 5 illustrates a logical mapping 524 associated with operating HVAC systems using occupancy sensing systems in accordance with one or more embodiments of the present disclosure. The mapping 524 may be referred to as an instance of an "ontology model" or a "semantic model." As shown in FIG. 5, the mapping 524 relates a space 528 of the building to a fixture 526 (or N quantity of fixtures) included therein. The mapping 524 additionally relates a space 528 (or N quantity of spaces) served by an HVAC (e.g., VAV) device 530 (or M quantity of HVAC devices). In some embodiments, a single space may be served by a single HVAC device. In some embodiments, multiple spaces may be served by a single HVAC device. In some embodiments, a single space may be served by multiple HVAC devices. It is to be understood that such variance results from differently sized spaces and different HVAC types, among other factors.

Figure 6:
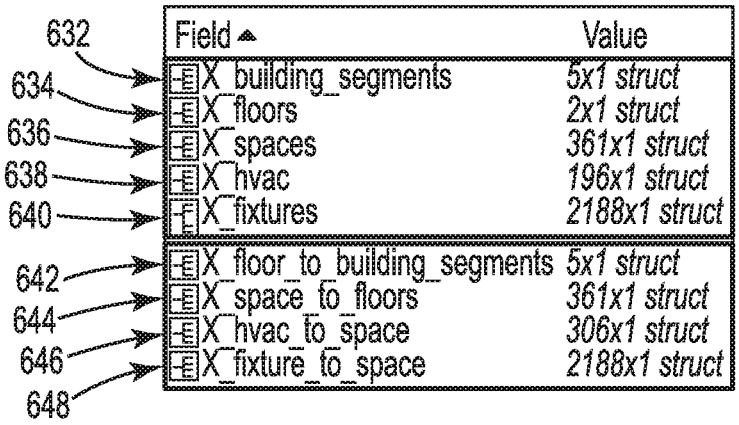
FIG. 6 illustrates an output table associated with operating HVAC systems using occupancy sensing systems in accordance with one or more embodiments of the present disclosure.

FIG. 6 illustrates an output table associated with operating HVAC systems using occupancy sensing systems in accordance with one or more embodiments of the present disclosure. The output table illustrated in FIG. 6 can be created by the computing device 102, previously described in connection with FIG. 1, for instance, based on the building information 110. The output table illustrated in FIG. 6 includes a plurality of items, each associated with a respective table such that selecting of the items causes display of the associated table. For instance, the output table illustrates in FIG. 6 includes an item 632 associated with a building segment definitory table, an item 634 associated with a floor definitory table, an item 636 associated with a spaces definitory table, an item 638 associated with an HVAC equipment (e.g., devices) definitory table, and an item 640 associated with a fixtures definitory table (cumulatively referred to as "definitory table items 632-640").

Selection of the item 632 can cause a building segment definitory table (illustrated in FIG. 7) to be displayed. Selection of the item 634 can cause a floor definitory table (illustrated in FIG. 8) to be displayed. Selection of item 636 can cause a spaces definitory table (illustrated in FIG. 9) to be displayed. Selection of the item 638 can cause an HVAC equipment definitory table (illustrated in FIG. 10) to be displayed. Selection of the item 640 can cause a fixtures definitory table (illustrated in FIG. 11) to be displayed.

In addition to the definitory table items 632-640, FIG. 6 includes an item 642 associated with a floor-to-building-segment mapping table, the selection of which can cause a floor-to-building-segment mapping table (illustrated in FIG. 12) to be displayed. FIG. 6 includes an item 644 associated with a space-to-floor mapping table, the selection of which can cause a space-to-floor mapping table (illustrated in FIG. 13) to be displayed. FIG. 6 includes an item 646 associated with a HVAC-to-space mapping table, the selection of which can cause an HVAC-to-space mapping table (illustrated in FIG. 14) to be displayed. FIG. 6 includes an item 648 associated with a fixture-to-space mapping table, the selection of which can cause a fixture-to-space mapping table (illustrated in FIG. 15) to be displayed.

FIG. 7 illustrates a building segment definitory table 732 in accordance with one or more embodiments of the present disclosure. As shown in FIG. 7, the table 732 can include identification numbers of building segments, the names of the building segments, and the names of the building segments as they appeared in the original representation (e.g., the building information). The term "building segment" can refer to a subset of building that is larger than a space. In some embodiments, for instance, a building segment can refer to a wing or area of the building. In some embodiments, a building segment can refer to a plurality of spaces.

FIG. 8 illustrates a floor definitory table 834 in accordance with one or more embodiments of the present disclosure. As shown in FIG. 8, the table 834 can include identification numbers of floors and the names of the floor.

FIG. 9 illustrates a spaces definitory table 936 in accordance with one or more embodiments of the present disclosure. As shown in FIG. 9, the table 936 can include identification numbers of spaces, the names of the spaces, and the names of the spaces as they appeared in the original representation (e.g., the building information).

FIG. 10 illustrates an HVAC equipment definitory table 1038 in accordance with one or more embodiments of the present disclosure. As shown in FIG. 10, the table 1038 can include identification numbers of HVAC devices (e.g., equipment), the names of the devices, and the names of the devices as they appeared in the original representation (e.g., the building information).

FIG. 11 illustrates a fixtures definitory table 1140 in accordance with one or more embodiments of the present disclosure. As shown in FIG. 11, the table 1140 can include identification numbers of fixtures, the names of the fixtures, the x-coordinates of the fixtures, the y-coordinates of the fixtures, the media access control (MAC) addresses of the fixtures, and the names of the fixtures as they appeared in the original representation (e.g., the building information).

FIG. 12 illustrates a floor-to-building-segment mapping table 1242 in accordance with one or more embodiments of the present disclosure. As shown in FIG. 12, the table 1242 can include identification numbers of floors mapped to identification numbers of building segments to which they belong, and floor names mapped to building segment names to which they belong. In some embodiments, floor names and/or building segment names may be descriptions of the identification numbers (e.g., to make them more readily understood by a reader) and may correlate with names in one or more of the definitory tables, previously discussed.

FIG. 13 illustrates a space-to-floor mapping table 1344 in accordance with one or more embodiments of the present disclosure. As shown in FIG. 13, the table 1344 can include identification numbers of spaces mapped to identification numbers of floors to which they belong, and space names mapped to floor names to which they belong. As previously discussed, space names and/or floor names may be descriptions of the identification numbers (e.g., to make them more readily understood by a reader) and may correlate with names in one or more of the definitory tables, previously discussed.

FIG. 14 illustrates an HVAC-to-space mapping table 1446 in accordance with one or more embodiments of the present disclosure. As shown in FIG. 1, the table 1446 can include identification numbers of HVAC devices mapped to identification numbers of spaces of which they provide ventilation, heating, and/or cooling, and HVAC device names mapped to space names of which they provide ventilation, heating, and/or cooling. In some embodiments, device names and/or space names may be descriptions of the identification numbers (e.g., to make them more readily understood by a reader) and may correlate with names in one or more of the definitory tables, previously discussed.

FIG. 15 illustrates a fixture-to-space mapping table 1548 in accordance with one or more embodiments of the present disclosure. As shown in FIG. 15, the table 1548 can include identification numbers of fixtures mapped to identification numbers of spaces in which they are installed, and fixture names mapped to space names in which they are installed. In some embodiments, fixture names and/or space names may be descriptions of the identification numbers (e.g., to make them more readily understood by a reader) and may correlate with names in one or more of the definitory tables, previously discussed.

Using one or more of the tables illustrated in FIGS. 7-15, a computing device (e.g., the computing device 102, previously described in connection with FIG. 1) can control the operation of HVAC devices to provide improved human comfort (e.g., provide ventilation, heating, and/or cooling) and/or save energy. The tables illustrated in FIGS. 7-15 provide a link between a space and the HVAC device(s) associated with that space (e.g., configured to provide ventilation, heating, and/or cooling in that space) and the fixture(s) associated with that space.

For example, referring back to FIGS. 2-4, if the fixture 214 determines occupancy, it can send a signal indicating that determination which can be received by the computing device. Because of the mapping(s) determined by embodiments herein, the space in which the fixture 214 is installed (e.g., "Medium Conference 1-1646") is known to be associated with a VAV device 318 (also illustrated in FIG. 4 as VAV device 418). In some embodiments, upon the determination of occupancy, the computing device can cause the VAV device 318 to be activated. In some embodiments, upon the determination of occupancy, the computing device can cause the VAV device 318 to modify its operation (e.g., set a temperature and/or airflow setpoints).

If the fixture 214 makes a determination that the space "Medium Conference 1-1646" is unoccupied, it can send a signal indicating that determination which can be received by the computing device. In some embodiments, upon the determination that a space is unoccupied, the computing device can cause the VAV device 318 to be deactivated. In some embodiments, upon the determination that a space is unoccupied, the computing device can cause the VAV device 318 to modify its operation (e.g., set a temperature and/or airflow setpoints).

Figure 16:
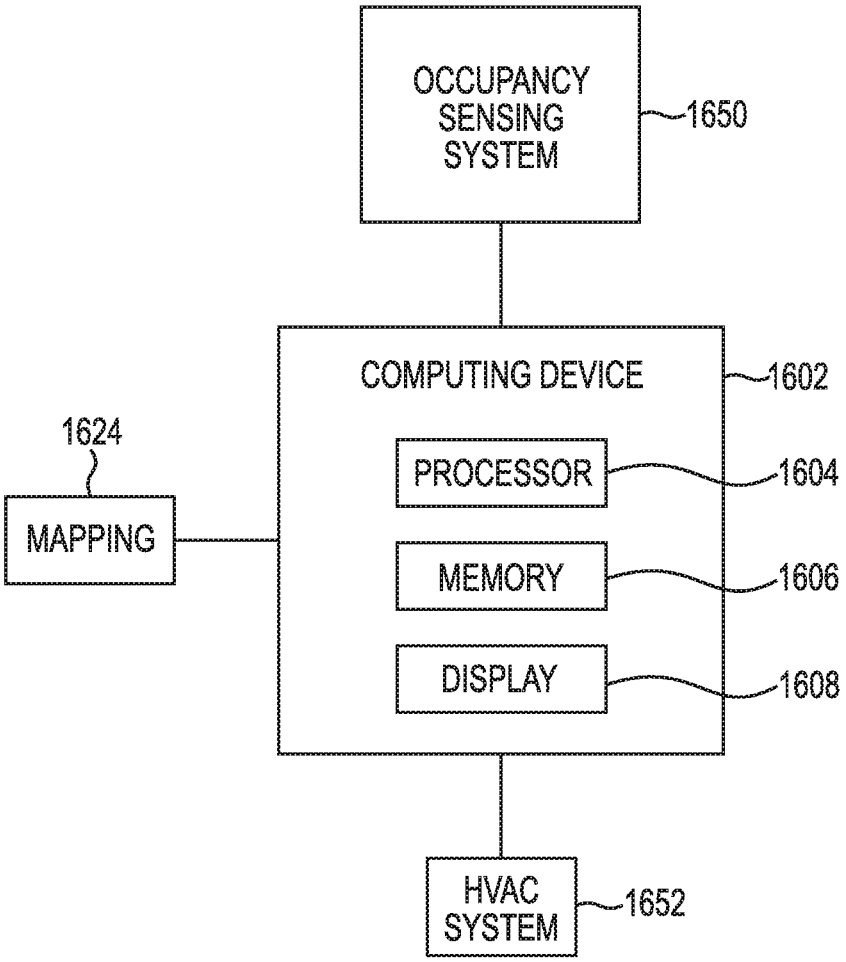
FIG. 16 illustrates a system for operating HVAC systems using occupancy sensing systems in accordance with one or more embodiments of the present disclosure.

FIG. 16 illustrates a system for operating HVAC systems using occupancy sensing systems in accordance with one or more embodiments of the present disclosure. The system illustrated in FIG. 16 can include a computing device 1602. In some embodiments, the computing device 1602 can be analogous to the computing device 102, previously described in connection with FIG. 1. The computing device 1602 can include a processor 1604, a memory 1606, and a display 1608. In some embodiments, one or more of these components may be analogous to the processor 104, the memory 106, and the display 108, previously described in connection with FIG. 1.

The computing device 1602 can determine and/or receive a mapping 1624. The mapping 1624 may be referred to as an instance of an "ontology model" or a "semantic model." As previously discussed, the mapping 1624 can relate a space of the building to a fixture (or N quantity of fixtures) included therein. The mapping 1624 additionally relates a space (or N quantity of spaces) served by an HVAC (e.g., VAV) device (or M quantity of HVAC devices). In some embodiments, a single space may be served by a single HVAC device. In some embodiments, multiple spaces may be served by a single HVAC device. In some embodiments, a single space may be served by multiple HVAC devices. It is to be understood that such variance results from differently sized spaces and different HVAC types, among other factors. In some embodiments, the mapping 1624 may be analogous to the mapping 524, previously described in connection with FIG. 5.

The computing device 1602 can communicate with an occupancy sensing system 1650 associated with the building. In some embodiments, the computing device 1602 can communicate with a controller of the occupancy sensing system 1650. The occupancy sensing system 1650 is a system used to detect the presence of a person in a given portion (e.g., space) of a building. The occupancy sensing system 1650 can include motion and/or presence detecting sensing devices (sometimes referred to herein as "occupancy sensors" or "sensors") employing infrared, ultrasonic, microwave, and/or other technologies, for instance. It is noted, however, that the occupancy sensing system 1650 is not limited herein to a particular type of sensor and/or sensing system. In some embodiments, the occupancy sensing system 1650 can be a digital ceiling.

The computing device 1602 can communicate with an HVAC system 1652. In some embodiments, the computing device 1602 can communicate with a controller of the HVAC system 1652. The HVAC system 1652 is a system used to control the environment of a building. For example, the HVAC system 1652 can be used to control the air temperature, humidity, and/or air quality of a building. The HVAC system 1652 can include a plurality of different devices and/or equipment, an example list including thermostats, fans, ducts, air conditioners, furnaces, humidifiers, variable air volume (VAV) devices (referred to herein as "VAVs"), air handling units (AHUs), rooftop units (RTUs), chillers, boilers, etc.

From communication(s) with the occupancy sensing system 1650, the computing device 1602 can determine an occupancy state of a space (or a plurality of spaces) of the building. Stated differently, the computing device 1602 can determine whether a particular space of the building is occupied. Based on that determination and the mapping 1624, the computing device can communicate with the HVAC system 1652 to control (e.g., adjust) the operation of one or more HVAC devices associated with that space.

Figure 17:
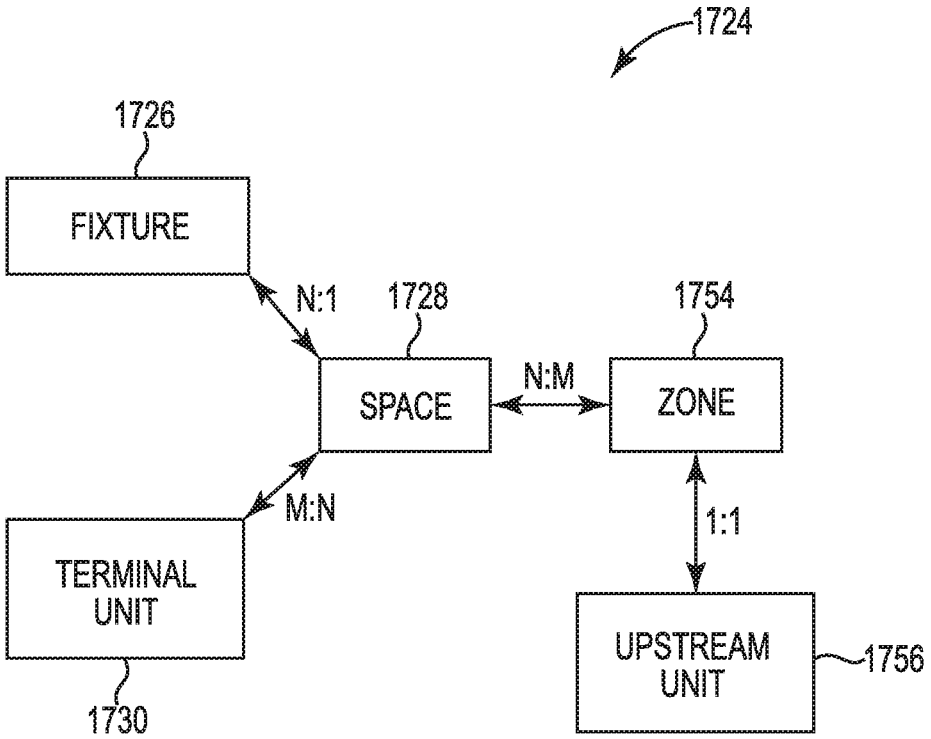
FIG. 17 illustrates another logical mapping associated with operating HVAC systems using occupancy sensing systems in accordance with one or more embodiments of the present disclosure.

FIG. 17 illustrates another logical mapping 1724 associated with operating HVAC systems using occupancy sensing systems in accordance with one or more embodiments of the present disclosure. The mapping 1724 may be similar to the mapping 524, previously described in connection with FIG. 5, and includes additional relationships. For instance, the mapping 1724 includes a zone 1754 and an upstream unit 1756. In a manner analogous to the mapping 524, the mapping 1724 may be referred to as an instance of an "ontology model" or a "semantic model." As shown in FIG. 17, the mapping 1724 relates a space 1728 of the building to a fixture 1726 (or N quantity of fixtures) included therein. The mapping 1724 additionally relates a space 1728 (or N quantity of spaces) served by an HVAC terminal unit (e.g., VAV device, Fan Coil Unit, etc.) (or M quantity of terminal units). In some embodiments, a single space may be served by a single terminal unit. In some embodiments, multiple spaces may be served by a single terminal unit. In some embodiments, a single space may be served by multiple terminal units. It is to be understood that such variance results from differently sized spaces and different HVAC terminal unit types, among other factors.

The mapping 1724 additionally relates a zone 1754 to an upstream unit 1756. An upstream unit, as referred to herein, is an HVAC device upstream of a terminal unit. In some embodiments, an upstream unit refers to an RTU. In some embodiments, an upstream unit refers to an AHU. Though one level of upstream unit 1756 is shown, embodiments of the present disclosure include different levels, such as boiler plants and/or chiller plants, which are upstream from an AHU or RTU. The zone 1754 refers to a particular plurality of spaces. A zone 1754 may be defined based on its relationship to the upstream unit 1756. For instance, the zone 1754 can refer to one or more spaces served by the upstream unit 1756. Stated differently, the upstream unit 1756 can be configured to provide heating and/or cooling to one or more spaces referred to cumulatively as the zone 1754. Accordingly, the mapping 1724 relates the space (or N quantity of spaces) 1728 to the zone (or M quantity of zones) 1754.

Figure 18:
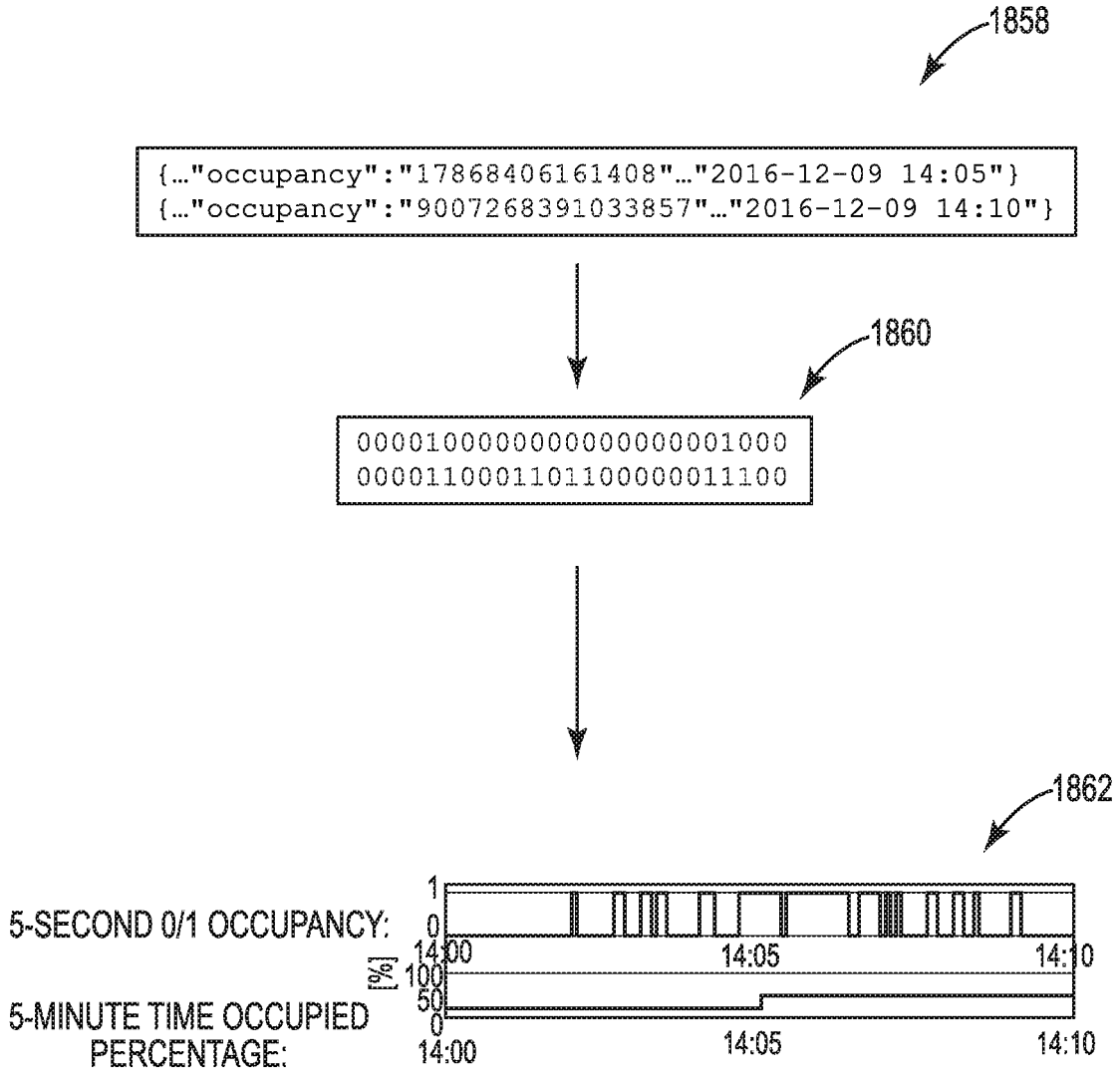
FIG. 18 illustrates occupancy data in accordance with one or more embodiments of the present disclosure.

FIG. 18 illustrates occupancy data in accordance with one or more embodiments of the present disclosure. The computing device 1602 can receive raw occupancy data 1858 (sometimes referred to herein simply as "occupancy data") from the fixtures of the occupancy sensing system 1650. In some embodiments, the raw occupancy data 1858 can be received in periodic batches from each fixture or from a controller associated with a plurality of fixtures. The batches of raw occupancy data 1858 may be coded in integer form. The computing device 1602 can convert the integer data to binary occupancy data 1860. In an example, each 5 second interval of a time period can be represented by a corresponding digit of the binary occupancy data 1860, where a 0 denotes that the fixture indicated "not occupied" and a 1 denotes that the fixture indicated "occupied." From the binary occupancy data 1860, the computing device 1602 can generate occupancy streams 1862 for each fixture. As shown in FIG. 18, occupancy streams 1862 can include a plot of 0/1 occupancy across a period of time. As shown in FIG. 18, occupancy streams 1862 can include a proportion of the period of time that a fixture indicated occupancy (e.g., "time occupied percentage").

Figure 19:
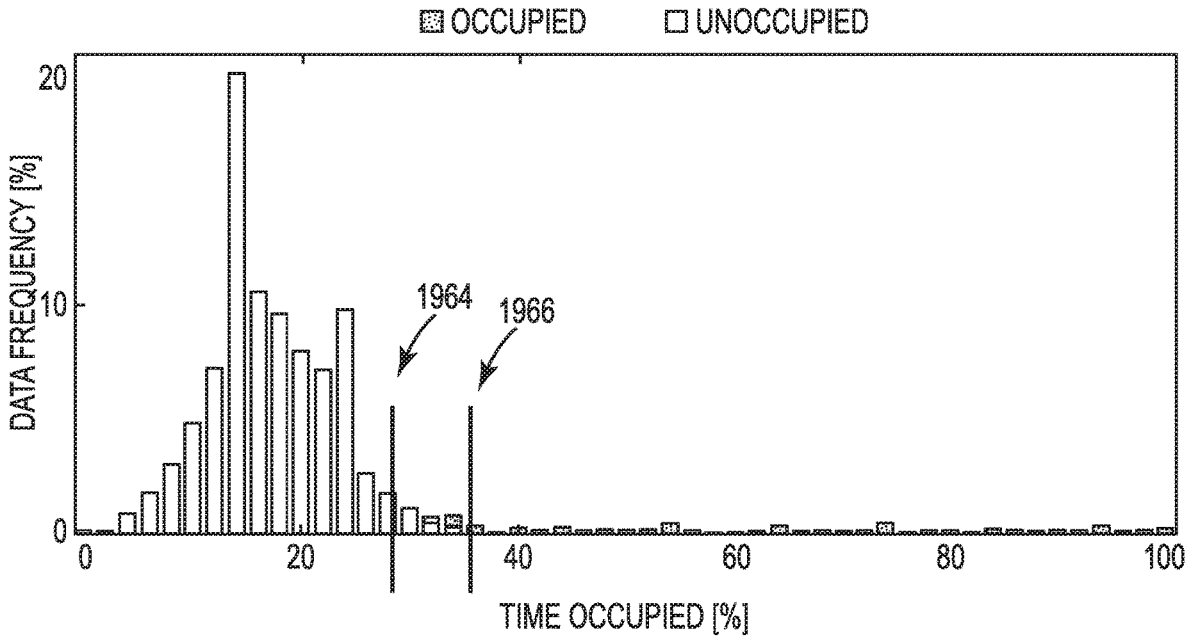
FIG. 19 illustrates an example histogram associated with filtering occupancy data in accordance with one or more embodiments of the present disclosure.

The computing device 1602 can filter the occupancy data to determine occupancy information. FIG. 19 illustrates an example histogram associated with filtering occupancy data in accordance with one or more embodiments of the present disclosure. The histogram illustrated in FIG. 19 can be used to determine an "occupied" threshold and an "unoccupied" threshold in order to remove noise from the occupancy data, for instance. In some embodiments, multiple periods associated with the occupancy data can be defined. For instance, a first period may be referred to as "potential occupancy" in a particular space and a second period may be referred to as "improbable occupancy" in the space. In an example of an office building, periods of potential occupancy may generally refer to business hours (e.g., 10:00 am to 4:00 pm weekdays) and periods of improbable occupancy may refer to late nights and/or weekends (e.g., 11:00 pm to 4:00 am weekdays and any time of day weekends). The periods can be user-defined, for instance. In some embodiments, the periods may be defined without user input based on historical information regarding the building.

The histogram illustrated in FIG. 19 includes frequency (e.g., number of occurrences over the time period) plotted against time occupied percentage. As shown, occupancy data associated with (e.g., gathered during) the potential occupancy period(s) is delineated from occupancy data associated with the improbable occupancy period(s). The computing device can determine an "occupied" threshold 1966 and an "unoccupied" threshold 1964 based on the occupancy data. In some embodiments, percentiles of the occupancy data may be used to determine the thresholds. For instance, the occupied threshold may be determined to be the 10th percentile ($p_{10}$) and the unoccupied threshold may be determined from $\min(2*p_{90}-p_{50}, p_{99})$. The thresholds determined can be used to filter the occupancy data to determine occupancy information. For instance, the computing device 1602 can perform hysteretic thresholding operations to filter the occupancy data to determine occupancy information. Occupancy information can refer to a binary classification (occupied or not occupied) gleaned from occupancy data.

Figure 20:
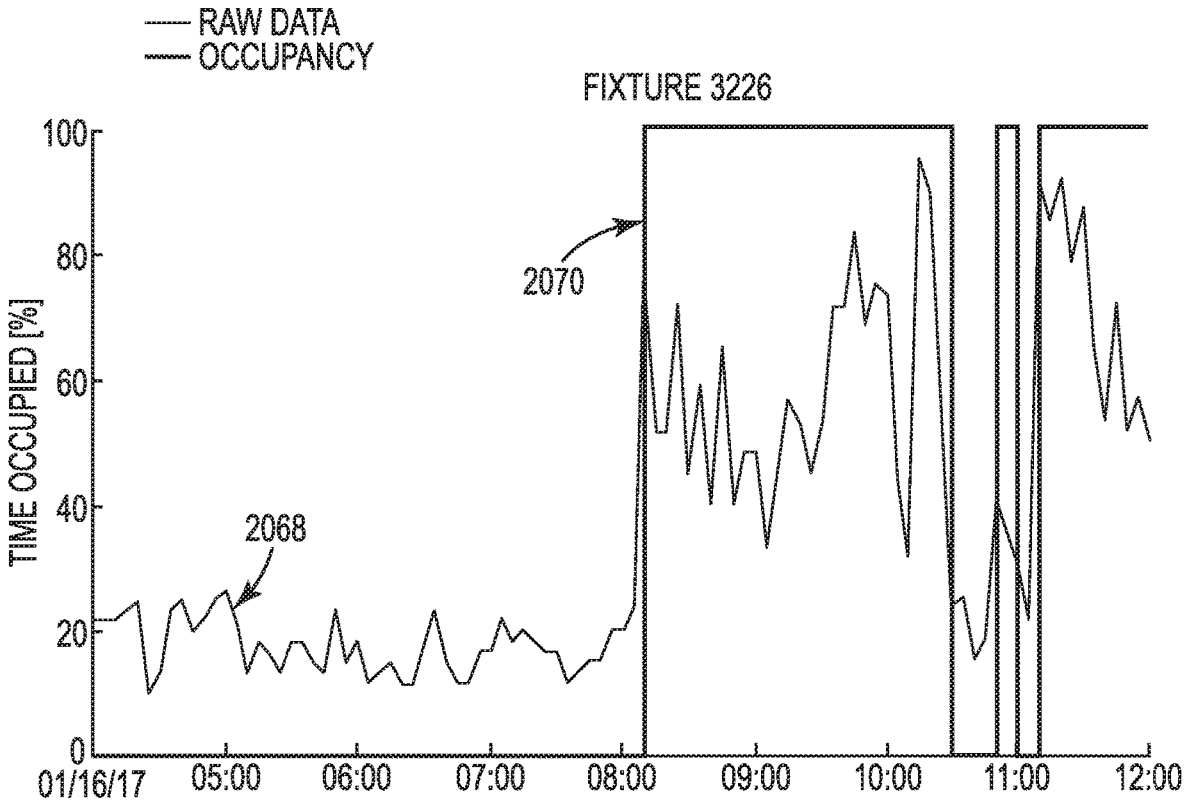
FIG. 20 illustrates examples of occupancy data and occupancy information for a particular fixture across a particular time period in accordance with one or more embodiments of the present disclosure.

FIG. 20 illustrates examples of occupancy data and occupancy information for a particular fixture across a particular time period in accordance with one or more embodiments of the present disclosure. The occupancy data 2068 indicates varying time occupied percentages while, as previously discussed, the occupancy information 2070 indicates a binary determination of occupied or not occupied at a given time. The occupancy information can be considered to represent the occupancy data after the previously discussed occupancy and non-occupancy thresholds have been applied.

From the occupancy information, the computing device 1602 can determine one or more occupancy patterns associated with spaces of the building. In some embodiments, for each fixture, occupancy intervals below a particular length (e.g., 10 minutes) may be removed from the occupancy information. Such removal can, for instance, reduce effects that walks through a space and/or cleaning services may have on determined occupancy.

The computing device 1602 can spatially group fixtures and analyze them for space occupancy. In some embodiments, a space can be considered to be occupied if at least a particular portion of the plurality of fixtures indicate that the space is occupied. In some embodiments, the portion is between 1% and 5%. Determining occupancy patterns can include determining a pattern of occupancy beginning and occupancy ending. Stated differently, for a given day, occupancy may be determined to begin at a first time and end at a second time.

Four methodologies for determining occupancy patterns are described herein, though it is to be understood that the present disclosure is not so limited. The methodologies are provided for example purposes. In a first and second methodology (sometimes respectively referred to herein as "Option A" and "Option B"), the computing device 1602 can determine occupancy starts and stops at the level of individual fixtures and then aggregate the starts and stops at a space-wide level. In a third and fourth methodology (sometimes referred to herein as "Option C" and "Option D"), the computing device 1602 can aggregate the fixture data to determine space occupancy profiles and then determine occupancy start and stop at a space-wide level. The first and second methodologies differ in that the first methodology aggregates first in time (e.g., via temporal aggregation) and then in space (e.g., via spatial aggregation), whereas the second methodology aggregates first in space and then in time. Similarly, the third and fourth methodologies differ in that after the aggregation in space the third methodology aggregates in time considering each instance of a day separately, whereas the fourth methodology aggregates in time via the average summed space occupancy information for each day type.

Figure 21:
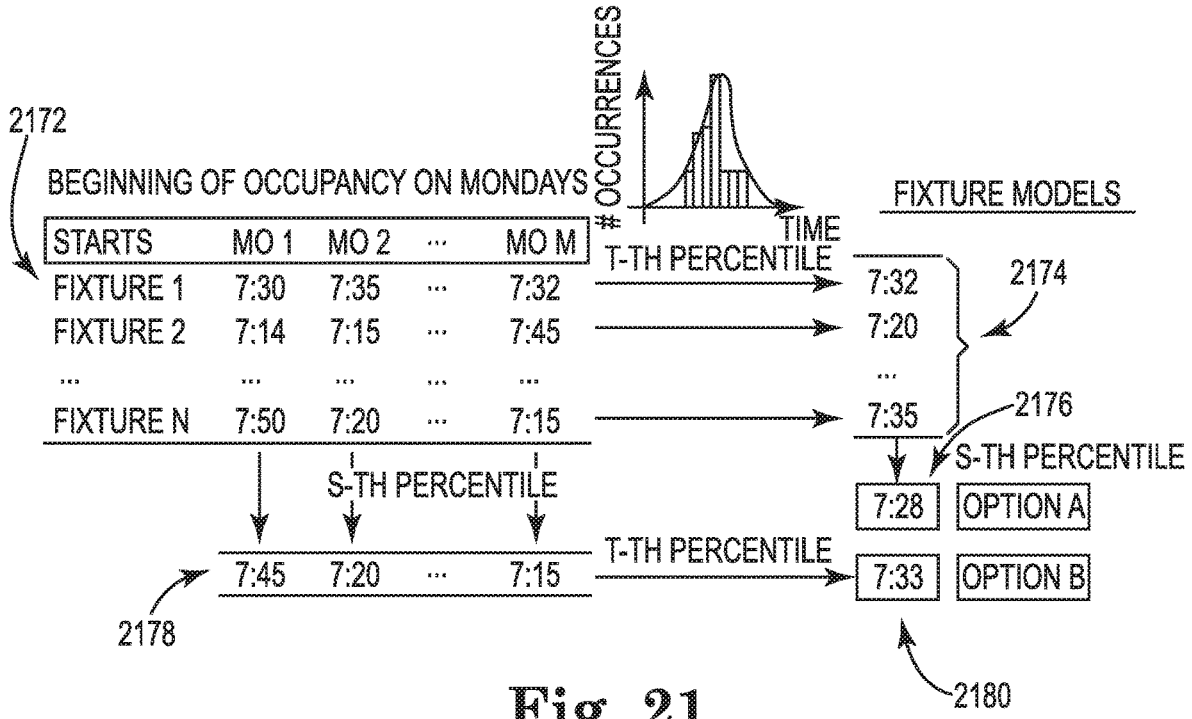
FIG. 21 illustrates a flow chart associated with determining occupancy patterns via a first methodology and a second methodology in accordance with one or more embodiments of the present disclosure.

FIG. 21 illustrates a flow chart associated with determining occupancy patterns via a first methodology and a second methodology in accordance with one or more embodiments of the present disclosure. The example illustrated in FIG. 21 illustrates occupancy beginning times (e.g., "starts"), though, as previously discussed, occupancy patterns in accordance with the present disclosure can include occupancy ending times in addition to, or in lieu of, occupancy beginning times. Additionally, the example illustrated in FIG. 21 illustrates a single day type, Monday. It is noted that occupancy patterns can be determined for additional and/or other day types. As referred to herein, a "day type" is an identifier of a category in which a particular calendar can be classified. For instance, "day type" can refer to a particular day of a week (e.g., Monday, Tuesday, Wednesday, etc.). In some embodiments, "day type" can refer to a portion of a week (e.g., one or more weekdays or weekend days). In some embodiments, "day type" can refer to a date and/or a holiday (e.g., the Fourth of July). An "instance" of a day type refers to a single day (e.g., a 24-hour calendar day) of that day type. For example, Tuesday, Oct. 16, 2018 can be an instance of day type "Tuesday" and can be an instance of day type "weekday."

As previously discussed, according to any of the first, second, third, and fourth methodologies, occupancy intervals of the occupancy information exceeding a threshold length can be determined for each fixture, and occupancy intervals below a particular length (e.g., 10 minutes) may be removed from the occupancy information. Such removal can, for instance, reduce effects that walks through a space and/or cleaning services may have on determined occupancy.

According to the first methodology, a first space occupancy model 2176 can be determined for each space individually, then, the individual space models can be spatially aggregated based on the mapping to determine a zone-level occupancy model. The computing device 1602 can determine the first occupied moment in time (e.g., in the morning) and the last occupied moment in time (e.g., in the evening) for each fixture individually and for each day of a given day type. A portion of this determined information is illustrated at 2172, which illustrates the first occupied moment in time for a plurality of fixtures over a plurality of Mondays (referred to cumulatively as "timestamps"). The computing device 1602 can utilize the timestamps for each day and each fixture individually and select a respective percentile thereof to determine fixture occupancy start or stop. For instance, in some embodiments, a fifth percentile of the timestamps can be selected for occupancy starts (e.g., shown in FIG. 21 as "T-th percentile"), and a 95th percentile can be selected for occupancy stops, though embodiments herein are not so limited. Thus, a model for each fixture can be determined which reflects the occupancy start time for that fixture on that day type. These models are shown at 2174. Though not illustrated in FIG. 21, similar models can be determined which reflect the occupancy stop time for fixtures on that day type (and different day types). The computing device 1602 can aggregate the individual fixture models 2174 for fixtures in a particular space to determine a first space-wide occupancy beginning time (e.g., occupancy model) 2176. Aggregation can be carried out using a particular percentile in a manner analogous to that previously discussed (e.g., S-th percentile), though embodiments herein are not so limited.

According to the second methodology, space occupancy starts 2178 (and stops, though not illustrated in FIG. 21) can be determined for each instance of a day of a given day type from starts and stops of individual sensors in the space that day instance, then a second space occupancy model 2180 can be determined that groups the space starts and stops by day type. As in the first methodology, the computing device 1602 can determine the first occupied moment in time and the last occupied moment in time for each fixture individually and for each day of a given day type. A portion of this determined information is illustrated at 2172, which illustrates a plurality of start timestamps over a plurality of Mondays. The computing device 1602 can determine space occupancy starts 2178 (and stops) for each instance of a day as a percentile of occupancy starts (and stops) for all the fixtures in the space that day. The computing device 1602 can aggregate the space occupancy starts 2178 (and stops) to determine a second space-wide occupancy beginning time (e.g., occupancy model) 2180 for a given day type as a percentile (e.g., T-th percentile) of space occupancy starts (and stops) determined for all days of that day type (e.g., Monday in the example illustrated in FIG. 21).

Figure 22:
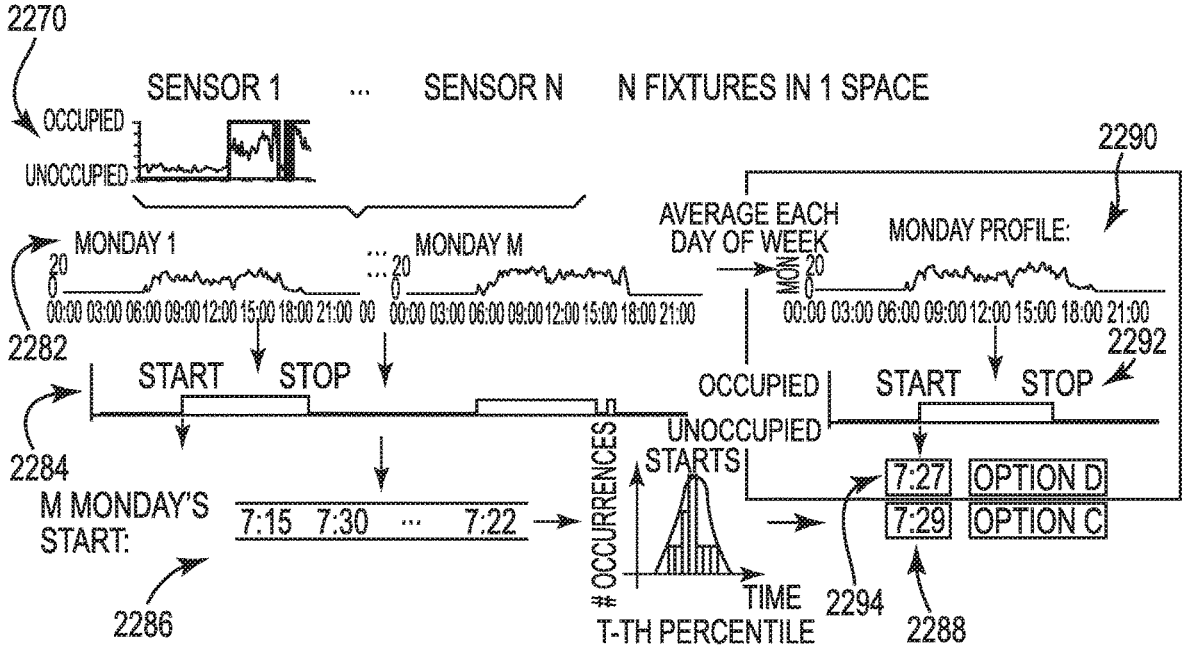
FIG. 22 illustrates a flow chart associated with determining occupancy patterns via a third methodology and a fourth methodology in accordance with one or more embodiments of the present disclosure.

FIG. 22 illustrates a flow chart associated with determining occupancy patterns via a third methodology and a fourth methodology in accordance with one or more embodiments of the present disclosure. According to the third methodology, a space-wide occupancy profile (e.g., occupancy starts (and stops) for a particular calendar day) can be determined from occupancy intervals of individual fixtures, then a third space occupancy model 2288 can be determined that groups the space starts and stops by day type. The computing device 1602 can sum the occupancy information 2270 corresponding to each of the individual fixtures in the space to determine summed space occupancy information 2282. The computing device 1602 can apply hysteretic thresholding to the summed space occupancy information 2282 in a manner analogous to that previously discussed to determine space-wide occupancy intervals 2284 for each instance of a day of a given day type (Monday is shown in the example illustrated in FIG. 22). From the space-wide occupancy intervals 2284, the computing device 1602 can determine space occupancy starts 2286 (and stops, though not shown), aggregate the space occupancy starts 2286, and select a percentile (e.g., T-th percentile) of the space occupancy starts 2286 as a third space-wide occupancy beginning time (e.g., occupancy model) 2288.

According to the fourth methodology, a space-wide occupancy profile (e.g., occupancy starts (and stops) in the space for a particular calendar day) can be determined from occupancy intervals of individual fixtures, then a fourth space occupancy model 2294 can be determined that averages the space starts and stops over instances (e.g., days) of a particular day type. The computing device 1602 can sum the occupancy information 2270 corresponding to each of the individual fixtures in the space to determine summed space occupancy information 2282. The computing device can average the summed space occupancy information 2282 over instances of the same day type calendar days to determine an average summed space occupancy information 2290 for each day type (though only Monday is shown in FIG. 22). The computing device 1602 can apply hysteretic thresholding to the average summed space occupancy information 2290 in a manner analogous to that previously discussed to determine space-wide occupancy intervals 2292 for each day type. From the space-wide occupancy intervals, the computing device 1602 can determine a fourth space-wide occupancy beginning time (e.g., occupancy model) 2294 (and ending time, though not shown).

It is noted that the first, second, third, and fourth methodologies may yield different determined space-wide occupancy beginning and/or ending times. For instance, as shown in FIGS. 21 and 22, the first space-wide occupancy beginning time 2176 is 7:28, the second space-wide occupancy beginning time 2180 is 7:33, the third space-wide occupancy beginning time 2288 is 7:29, and the fourth space-wide occupancy beginning time 2294 is 7:27. Because of the increased utilization of individual fixture data in the first and second methodologies, the first or second methodology may be selected in cases with a reduced quantity of occupancy sensors (e.g., fewer than 100 per space) and/or in cases where scalable computational resources are available that are configured to handle a larger number of fixtures in parallel (e.g., in a cloud environment). The first methodology may be selected in lieu of the second methodology as the quantity of occupancy sensors is reduced. The third and fourth methodologies may be selected in cases with an increased quantity of occupancy sensors (e.g., more than 100 per space) and/or in cases with limited computational resources (e.g., non-distributed computing environments). While the fourth methodology is the least computationally expensive of the four methodologies discussed as examples herein, the third methodology may be selected in cases where robustness against calendar anomalies within day types is desired.

Whether determined using one of the four methodologies discussed herein or by another, the zone-level occupancy beginning and/or ending time(s) can be used to modify the operations of upstream HVAC devices (e.g., RTUs, AHUs, boilers, chillers, etc.) that serve multiple spaces. In some embodiments, the computing device 1602 can cause an upstream HVAC device to be active and/or have a schedule set to "occupied" whenever at least one space conditioned by a thermostat supplied by the upstream HVAC device has an "occupied" state.

Schedules for upstream HVAC devices can be determined based on the occupancy model and by additional considerations. For instance, a schedule can be determined based on safety intervals, such as optimum start time in the morning (considering the time duration of morning transients), for instance, or on an amount of time a particular upstream HVAC device needs to operate (e.g., "warm up") before it is fully functional.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A non-transitory machine-readable medium having instructions stored thereon which, when executed by a processor, cause the processor to:

receive information in a first format from a building information model describing a plurality of spaces of a building;

receive information in a second format from an occupancy sensing system describing locations of a plurality of occupancy sensing fixtures;

receive information in a third format from a Heating, Ventilating and Air Conditioning (HVAC) system describing a plurality of HVAC devices;

processing the information from the building information model, the information from the occupancy sensing system and the information from the HVAC system to create a mapping describing relationships between a space of the plurality of spaces, an occupancy sensing fixture of the plurality of occupancy sensing fixtures, and an upstream HVAC device of the plurality of HVAC devices associated with the building, wherein the upstream HVAC device is configured to serve a zone including the space;

receive occupancy data determined by the occupancy sensing fixture over a period of time;

filter the occupancy data to determine occupancy information associated with the occupancy sensing fixture over the period of time;

determine an occupancy model associated with the space based on the occupancy information associated with the occupancy sensing fixture; and modify an operation of the upstream HVAC device based on the mapping and the occupancy model;

wherein at least one of the first format, the second format and the third format is different from the others of the first format, the second format and the third format.

2. The medium of claim 1, wherein the upstream device is one of: a rooftop unit (RTU) and an air handling unit (AHU).

3. The medium of claim 1, wherein the zone that the upstream HVAC device is configured to serve includes the space and other spaces of the plurality of spaces.

4. The medium of claim 1, including instructions to filter the occupancy data based, at least in part, on user-defined periods of potential occupancy of the space and user-defined periods of improbable occupancy of the space.

5. The medium of claim 4, including instructions to filter the occupancy data using a hysteretic thresholding operation based on the user-defined periods of potential occupancy of the space and user-defined periods of improbable occupancy of the space.

6. The medium of claim 5, including instructions to determine a threshold associated with the hysteretic thresholding operation based on a particular percentile of a histogram associated with a proportion of the period of time that the occupancy sensing fixture indicated occupancy in the space.

7. The medium of claim 1, wherein the instructions to determine the occupancy model associated with the space include instructions to determine a pattern of occupancy beginning time and occupancy ending time over the period of time.

8. The medium of claim 7, wherein the instructions to determine the occupancy model associated with the space include instructions to determine a respective pattern of occupancy beginning time and occupancy ending time particular to each occupancy sensing fixture of installed in the space.

9. The medium of claim 7, wherein the instructions to determine the occupancy model associated with the space include instructions to determine an occupancy pattern associated with the space that is nonspecific to a particular occupancy sensing fixture installed in the space.

10. A computing device, comprising:

a communication interface operatively coupled to a heating, ventilation, and air conditioning (HVAC) system controller and an occupancy system controller, wherein the occupancy system controller is separate from the HVAC system controller, the HVAC system controller controlling an HVAC system including a plurality of HVAC components in a building and the occupancy system controller controlling an occupancy sensing system that includes a plurality of occupancy sensing fixtures in the building, the computing device including a processor and a memory having instructions stored thereon which, when executed by the processor, cause the processor to:

receive a mapping describing relationships between a plurality of spaces of the building, the plurality of occupancy sensing fixtures of the occupancy sensing system, and the plurality of HVAC components of the HVAC system;

receive from the occupancy sensing system occupancy data determined by the plurality of occupancy sensing fixtures over a period of time;

filter the occupancy data to determine occupancy information associated with each occupancy sensing fixture of the occupancy sensing system over the period of time;

determine an occupancy model associated with the space based on the occupancy information associated with the occupancy sensing fixtures; and communicate with the HVAC system controller to cause the HVAC system controller to modify an operation of one or more of the plurality of HVAC components based on the mapping and the occupancy model.

11. The computing device of claim 10, including instructions to receive from the occupancy sensing system the occupancy data in integer batches and convert the integer batches to binary digits.

12. The computing device of claim 10, wherein the period of time exceeds six days.

13. The computing device of claim 10, including instructions to determine a respective occupancy beginning time and occupancy ending time for each of a plurality of day types.

14. The computing device of claim 10, wherein the instructions to determine the occupancy model include instructions to determine that the space is occupied responsive to a determination that at least a particular portion of the plurality of occupancy sensing fixtures indicate that the space is occupied.

15. A method of operating a heating, ventilation, and air conditioning system using an occupancy sensing system, comprising:

receiving information from a building information model describing a plurality of spaces of a zone of a building;

receiving information from an occupancy sensing system describing locations of a plurality of occupancy sensing fixtures;

receive information in a third format from a Heating, Ventilating and Air Conditioning (HVAC) system describing a plurality of Air Handling Units (AHUs);

processing the information from the building information model, the information from the occupancy sensing system and the information from the HVAC system to create a mapping describing relationships between the plurality of spaces, the plurality of occupancy sensing fixtures installed in the building, and the a plurality of AHUs associated with the building; and receiving occupancy data determined by the plurality of occupancy sensing fixtures over a period of time;

for each occupancy sensing fixture, filtering the occupancy data based on user-defined periods of potential occupancy of the space and user-defined periods of improbable occupancy of the space to determine occupancy information associated with the occupancy sensing fixture over the period of time;

for each space, determining a model of occupancy beginning time and occupancy ending time over the period of time based on the occupancy information; and operating a particular AHU corresponding to the zone of the building during a time interval corresponding to the occupancy beginning time and occupancy ending time based on the mapping and the occupancy model.

16. The method of claim 15, wherein the method includes operating the particular AHU during the time interval responsive to a determination that, according to the model, at least one space of the zone is determined to be occupied.

17. The method of claim 15, wherein determining the model of occupancy beginning time for a particular space includes:

determining a respective occupancy beginning time associated with each fixture installed in the space for each of a plurality of calendar days;

for each occupancy sensing fixture installed in the space, determining an occupancy beginning time associated with the occupancy sensing fixture for a particular day type based on an aggregation of respective occupancy beginning times associated with each occupancy sensing fixture installed in the space for each of a plurality of calendar days of the particular day type; and determining the model of occupancy beginning time for a particular space associated with the particular day type based on an aggregation of occupancy beginning times for the particular day type of occupancy sensing fixtures installed in the space.

18. The method of claim 15, wherein determining the model of occupancy beginning time for a particular space includes:

determining a respective occupancy beginning time associated with each occupancy sensing fixture installed in the space for each of a plurality of calendar days;

for each calendar day of the plurality of calendar days, determining a calendar day occupancy beginning time based on an aggregation of the respective occupancy beginning time associated with each occupancy sensing fixture installed in the space for each of the plurality of calendar days; and determining the model of occupancy beginning time for a particular space and for a particular day type based on an aggregation of calendar day occupancy beginning times of calendar days of the particular day type.

19. The method of claim 15, wherein determining the model of occupancy beginning time for a particular space includes:

determining summed space occupancy information based on occupancy information associated with each occupancy sensing fixture installed in the space;

determining a space-wide occupancy interval for each calendar day of a plurality of calendar days of the period of time based on the summed space occupancy information;

determining a respective occupancy beginning time associated with each of a plurality of occupancy sensing fixtures installed in the particular space for a particular calendar day of the plurality of calendar days based on the space-wide occupancy interval for each calendar day of the plurality of calendar days; and determining a model of occupancy beginning time for the particular space corresponding to a particular day type of a plurality of day types based on an aggregation of respective occupancy beginning times associated with occupancy sensing fixtures installed in the space across a plurality of instances of the day type.

20. The method of claim 15, wherein determining the model of occupancy beginning time for a particular space includes:

determining summed space occupancy information for each calendar day of a plurality of calendar days based on occupancy information associated with each occupancy sensing fixture installed in the space;

determining average summed space occupancy information for a day type based on a portion of the summed space occupancy information associated with the day type; and determining the model of occupancy beginning time for the particular space based on the average summed space occupancy information for the day type.

* * * * *